US005562226A

United States Patent [19]

Valyi et al.

[11] Patent Number: 5,562,226

[45] Date of Patent: Oct. 8, 1996

[54] CONTAINER CLOSURE ASSEMBLY

[75] Inventors: Emery I. Valyi, Katonah, N.Y.; Charles J. Brun, Xenia, Ohio

[73] Assignee: EV Family Limited Partnership, New York, N.Y.

[21] Appl. No.: 221,567

[22] Filed: Apr. 1, 1994

Related U.S. Application Data

[63] Continuation-in-part of Ser. No. 96,426, Jul. 26, 1993, Pat. No. 5,325,976.

[51] Int. Cl.[6] ..... A65D 17/00

[52] U.S. Cl. ..... 220/258; 215/232

[58] Field of Search ..... 220/258, 278, 220/277; 215/232, 257, 228

[56] References Cited

U.S. PATENT DOCUMENTS

| | | | |
|---|---|---|---|
| 3,951,331 | 4/1976 | Smith et al. | 220/258 |
| 4,044,941 | 8/1977 | Knudsen | 220/258 |
| 4,580,682 | 4/1986 | Gorski et al. | 220/258 |
| 4,588,099 | 5/1986 | Diez | 215/232 |
| 4,793,504 | 12/1988 | Towns et al. | 220/258 |
| 4,813,578 | 3/1989 | Gordon et al. | 220/258 |
| 4,930,646 | 6/1990 | Emslander | 215/232 |
| 5,082,136 | 1/1992 | Schumann | 220/278 |
| 5,090,582 | 2/1992 | Art et al. | 215/250 |
| 5,205,430 | 4/1993 | Valyi | 220/278 |

FOREIGN PATENT DOCUMENTS

| | | | |
|---|---|---|---|
| 1417219 | 10/1965 | France | 220/258 |

*Primary Examiner*—Joseph M. Moy
*Attorney, Agent, or Firm*—Bachman & LaPointe, P.C.

[57] ABSTRACT

A container closure assembly including a container, a barrier layer and a closure member. The barrier layer and closure member completely cover the access opening to the container and the barrier layer includes a weakened portion thereof with a discontinuity therein which is broken open on removing the closure member.

14 Claims, 4 Drawing Sheets

CONTAINER CLOSURE ASSEMBLY

CROSS-REFERENCE TO RELATED APPLICATIONS

This application is a continuation-in-part of application Ser. No. 08/096,426, filed Jul. 26, 1993, now U.S. Pat. No. 5,325,976.

BACKGROUND OF THE INVENTION

The present invention deals with a container closure assembly including a tamper proof closure and a barrier layer.

It is highly desirable to provide a container with a tamper-evident closure capable of being easily opened and reclosed without the use of a tool and also incorporating a gas permeation barrier, particularly when it is necessary to maintain the integrity of the contents of the container, as for example carbonated beverages. Thus, the closure should at least in part include a gas barrier layer in order to maintain the integrity of the container contents prior to opening. In addition, the closure should have the ability of showing whether or not it has been damaged or tampered with and it should also be sufficiently reclosable to avoid contamination of the contents after the opening of the container.

Heretofore, it has been difficult to accomplish the foregoing, especially with both plastic and metal closures, suitable for plastic containers and metal cans, respectively. It is clearly advantageous to utilize a closure as aforesaid, usually made of the same material as the container, but also with other combinations, e.g., a plastic closure for a metal can, or a metal closure with a plastic jar. For greater convenience in recycling, the closure and container materials should be the same.

It is also desirable to provide a container closure assembly as aforesaid which is easy to prepare commercially and which is convenient and easy to use by the consumer.

Accordingly, it is a principal objective of the present invention to provide a container closure assembly including a barrier layer, wherein the closure is resistant to gas permeation, is tamper-evident and is capable of being easily opened and reclosed.

It is a still further object of the present invention to provide a closure assembly as aforesaid which is easy to prepare, inexpensive and easy to use in practice.

Further objects and advantages of the present invention will appear hereinbelow.

SUMMARY OF THE INVENTION

In accordance with the present invention, the foregoing objects and advantages are readily obtained.

A container closure assembly is provided in accordance with the present invention including: a container having a container neck and a rim portion defining an access opening for the container; a barrier layer having a rim and a central portion completely covering the access opening and with the barrier layer rim portion hermetically attached or adhered to said container, including a weakened portion of said barrier layer in the central portion of the barrier layer comprising at least one discontinuity; a removable closure member adapted to cover said container access opening and barrier layer and engaging said barrier layer, said closure member intimately contacting said barrier layer when said closure member is removed by twisting; whereby removal of the closure member by twisting breaks the barrier layer at the weakened portion and opens the container. Preferably, the weakened portion is adjacent the barrier layer rim portion.

The discontinuity in the barrier layer which represents the weakened portion is preferably a plurality of perforations circumscribing the barrier layer central portion adjacent the barrier layer rim. The perforations preferably go completely through the barrier layer, although they may go partially through the barrier layer. If the perforations go completely through the barrier layer, they are sealed by a gas impervious material, as with a plastic or a wax, said material offering negligible resistance to shear.

In a preferred embodiment, the closure and the barrier layer include stepped portions adjacent one another over the access opening, with the stepped portions extending either outwardly away from the access opening or inwardly towards the access opening. Preferably also the barrier layer stepped portion includes corner portions, as for example, the barrier layer stepped portion defining a hexagonal configuration. Thus, on twisting the closure member to remove same, the closure member places the stepped portion of the barrier layer under torsion breaking the barrier layer at the weakened portion.

The closure member preferably defines a snap ring which engages the container neck. Also, the barrier layer preferably includes an annular rim portion which is bonded to or mechanically attached to the container rim. The weakened portion may be a brittle layer or a series of perforations in the barrier layer central portion which may be sealed by a polymeric or wax material to prevent loss of carbonation. Thus, the container closure assembly of the present invention includes a barrier layer which protects the integrity of the contents of the container. Moreover, the assembly is tamper evident since one can readily see if the weakened portion of the barrier layer has been broken, as for example with a transparent closure member. Further, the closure assembly is easy to use and may readily be reapplied to the container, albeit without the integrity of the barrier layer, after partial use of the contents.

Further features and advantages of the present invention will appear hereinbelow.

BRIEF DESCRIPTION OF THE DRAWINGS

The present invention will be more readily understandable from a consideration of the following illustrative and partly schematic drawings wherein.

DETAILED DESCRIPTION

Figure 1:
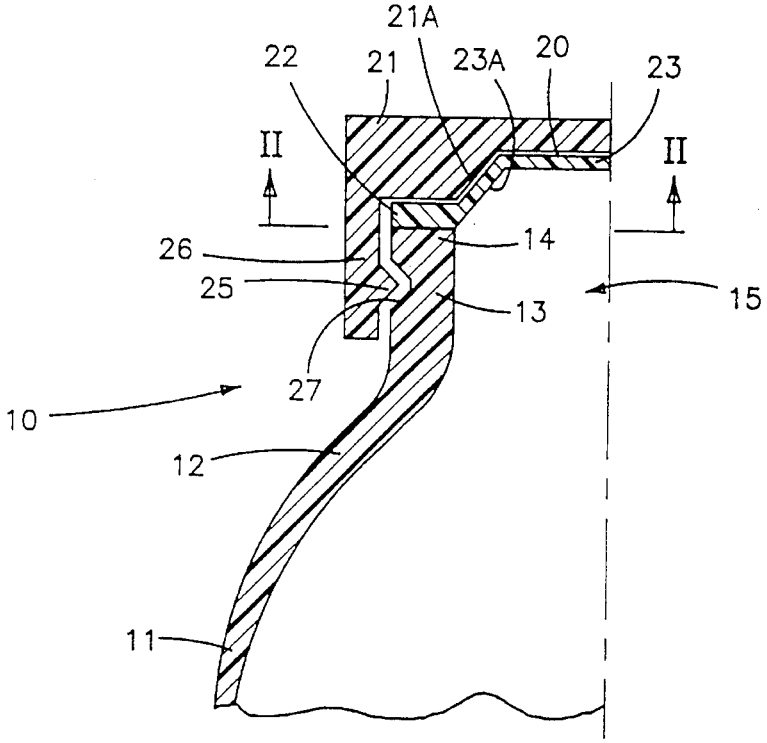
FIG. 1 is a partial sectional side view of a container closure assembly of the present invention.

FIG. 1 shows a partial sectional side view of container 10 having a container side wall 11 extending upwardly from a container bottom (not shown), container shoulder 12 extending upwardly from the container side wall, container neck 13 extending upwardly from the shoulder portion, and terminating in a container rim portion 14 defining an access opening 15 for container 10. The container 10 may be made of a plastic material, as polyethylene terephthalate (PET), or metal, as aluminum.

The closure assembly includes a barrier layer 20 and a closure member 21. The barrier layer may be made of the same plastic as the container having at least the same resistance to gas permeation as the container. Thus, if the container is made of the types of PET normally used for beverage bottles, the barrier layer may be made of the same grade of PET or one that is more permeation resistant, e.g., due to high crystallinity, or it may contain EVOH, both of which are compatible with the first mentioned PET for recycling. The barrier layer may be metal, e.g., aluminum, particularly for use with a metallic container. The closure member must be made of a rigid material and may if plastic be made transparent so that the barrier layer can be seen. The barrier layer may be made by thermoforming or injection molding.

Barrier layer 20 has a rim portion 22 and a central portion 23 and completely covers access opening 15. Rim portion 22 of barrier layer 20 is hermetically attached to container rim 14 to provide a gas impervious closure attachment for the unopened container.

Removable closure member 21 is provided over container 10 and covering the container rim and a portion of the container neck as well as the barrier layer. Closure member 21 may have a snap ring 25 positioned on the inside of descending closure member leg 26 and engaging recess 27 in container neck 13 so that the closure member can be snapped in place and simply removed by snapping the closure off or by twisting.

Figure 2:
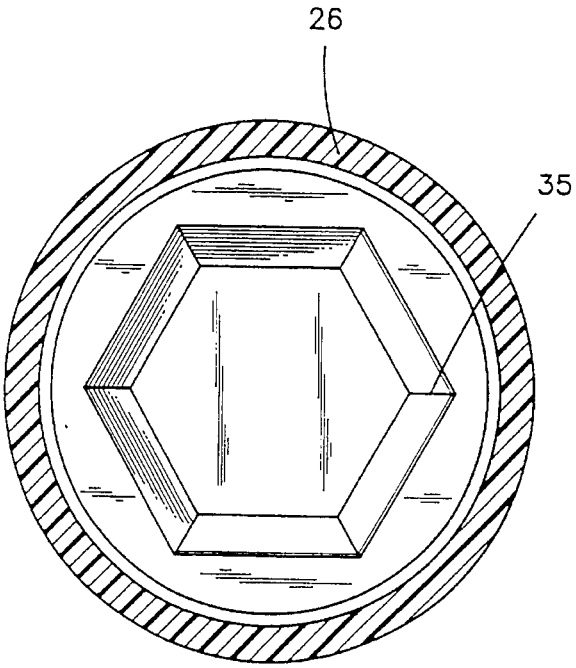
FIG. 2 is a sectional view through line II—II of FIG. 1.
Figure 3:
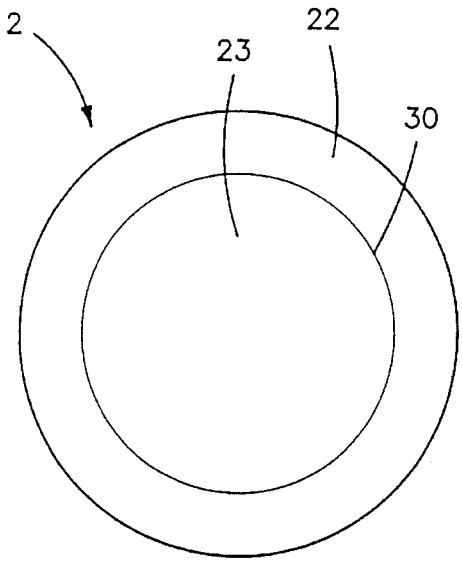
FIG. 3 is a top view of an injection molded barrier layer of the present invention.
Figure 4:
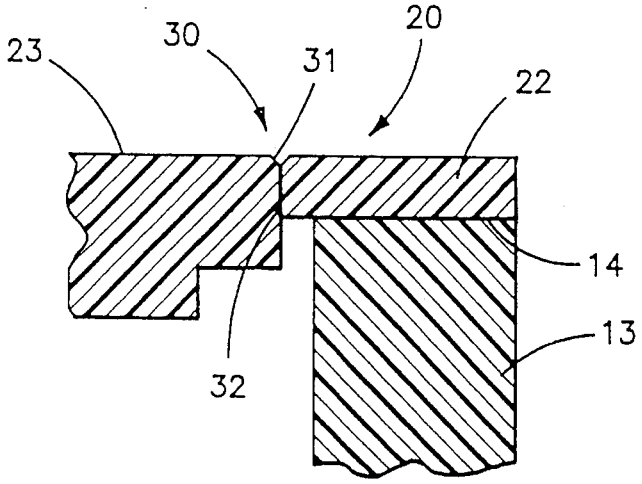
FIG. 4 is a partial enlarged sectional side view of a barrier layer-container interface.

As shown in FIG. 1, barrier layer central portion 23 includes a stepped portion 23A extending outwardly, away from access opening 15. Similarly, closure member 21 includes a corresponding stepped portion 21A also extending outwardly away from access opening 15. In addition, barrier layer 20 includes a weakened portion 30 in the barrier layer central portion 23 spaced inwardly of barrier layer rim portion 22. The weakened portion 30 is clearly shown in FIG. 4 and may comprise a notch 31 or a brittle welded seam 32 or combinations of these such as is shown in FIG. 4. The welded seam is a preferred embodiment for a plastic barrier layer, and is prepared by injection molding the barrier layer such as to first injection molding rim portion 22 followed by second injection molding the central portion 23 to include an interface 30 between the first and second molded portions wherein the interface 30 defines the weakened and usually brittle portion. The first and second injection molding steps result in a welded seam known in the art as a cold-weld which represents a brittle weakening between the rim portion and the central portion of the barrier layer, which represents a weakened location between the rim and central portions of the barrier layer. Thus, the weakened portion 30 may comprise the brittle interface between the two welded portions and/or a notched portion, both of which being shown in FIG. 4. FIG. 3 represents a top view of an injection molded barrier layer of the present invention wherein the barrier layer rim portion 22 was injection molded in a first step and the barrier layer central portion 23 was injection molded in a second step to form brittle interface or weakened portion 30 therebetween. Naturally, the central portion 23 may be injection molded in the first step and the rim portion injection molded in the second step, if desired. Barrier layer 20 is a generally annular or circular component conforming to the shape of a bottle or container rim portion 14 in order to allow a complete heat seal or welding between the barrier layer rim portion 22 and the container rim 14. As shown in FIG. 2, stepped portion 23A includes corner portions 35 and may be polygonal in cross section, such as the hexagonal configuration in FIG. 2 or the square configuration in FIG. 6. The stepped portion 23A of barrier layer 20 forms a dome-like configuration in FIG. 1. The corresponding stepped portions of the barrier layer and closure member are adjacent one another.

Thus, in accordance with the present invention, removal of the closure member by twisting puts pressure on the corresponding stepped portion of the barrier layer and breaks the seal at the weakened portion, opening the container. It is highly advantageous that the barrier layer remain in place until the closure member is twisted breaking the barrier layer at the weakened portion. Moreover, one can readily determine if the container has been previously opened by determining the integrity of the barrier layer. Thus, for example, one can determine visually through the container or through a transparent closure member if the barrier layer has been broken. Further, removing the closure member breaks the barrier layer audibly so that one can readily hear if the barrier layer is properly broken for the first time by twisting the closure member and removing same as by snapping or twisting. In addition, the container can be reclosed by simply snapping on the closure member, albeit without the integrity of the barrier layer. Naturally, also, a screw closure can be used, if desired.

Figure 5:
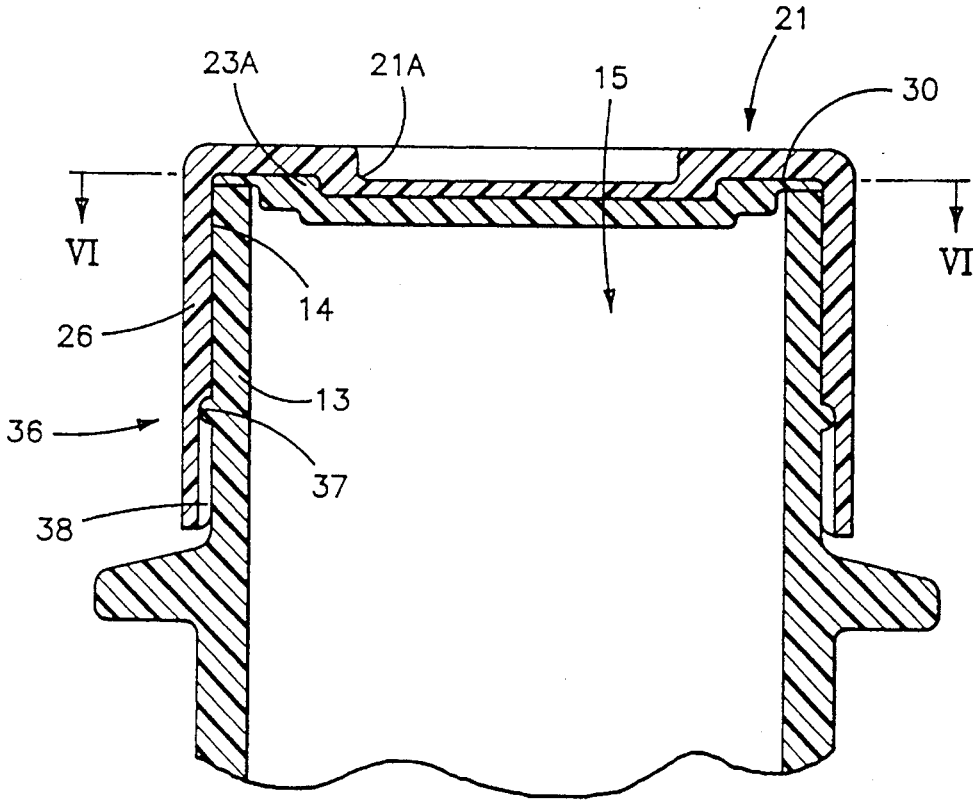
FIG. 5 is a partial sectional side view of an alternate embodiment of a container closure assembly of the present invention.
Figure 6:
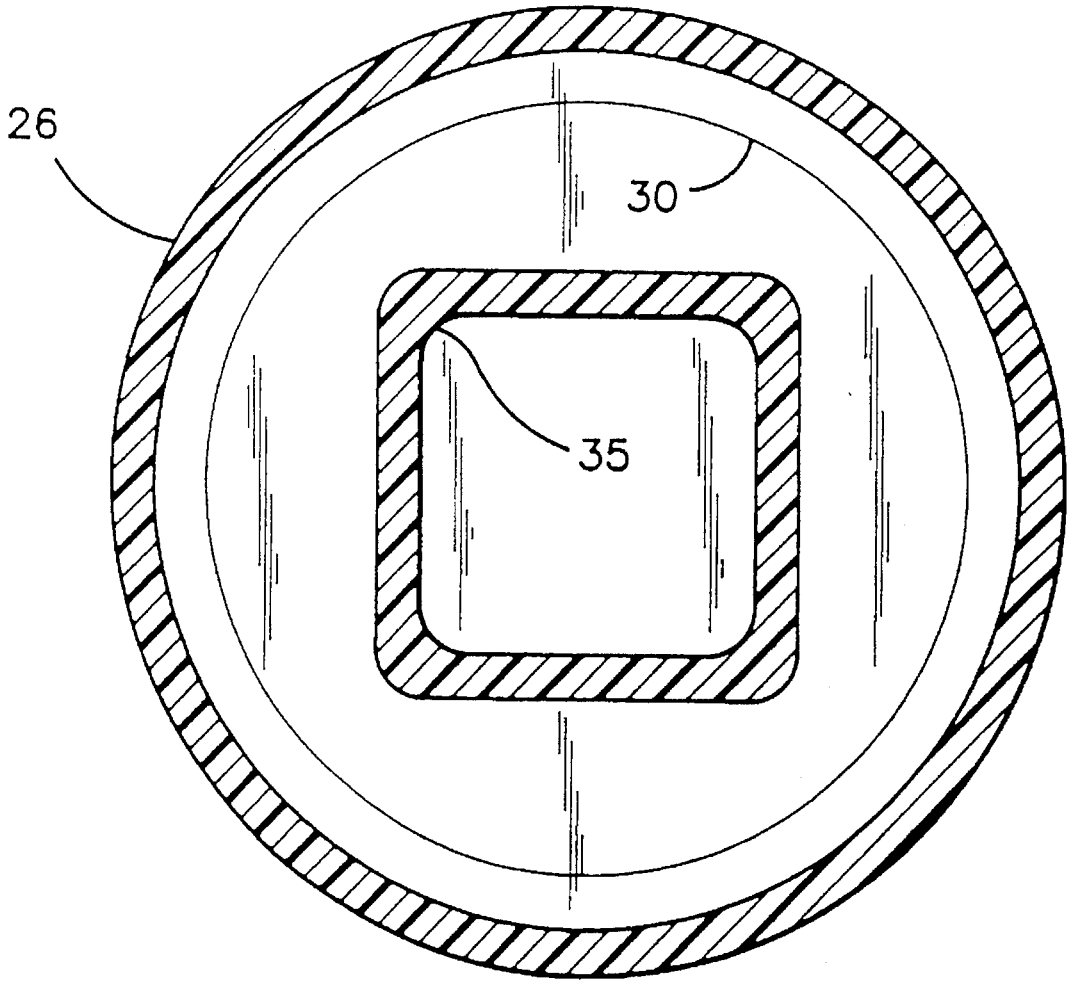
FIG. 6 is a sectional view through line VI—VI of FIG. 5.

FIGS. 5 and 6 represent an alternative embodiment of the present invention wherein the corresponding stepped portions 21A and 23A extend inwardly towards access opening 15. Also, as shown in FIGS. 5 and 6, snap ring 36 is defined by projection 37 on container neck 13 engaging groove 38 on closure member 21 descending leg 26. In the embodiment of FIGS. 5 and 6, weakened portion 30 is defined by a brittle welded zone between a first and second injection molded part.

Thus, in accordance with the present invention, a container closure assembly is provided which provides a firm barrier layer which is readily opened by simply twisting the closure member. At the same time, the closure assembly provides a tamper evident seal. Further, the closure assembly of the present invention is simple to prepare and use by the consumer.

Figure 7:
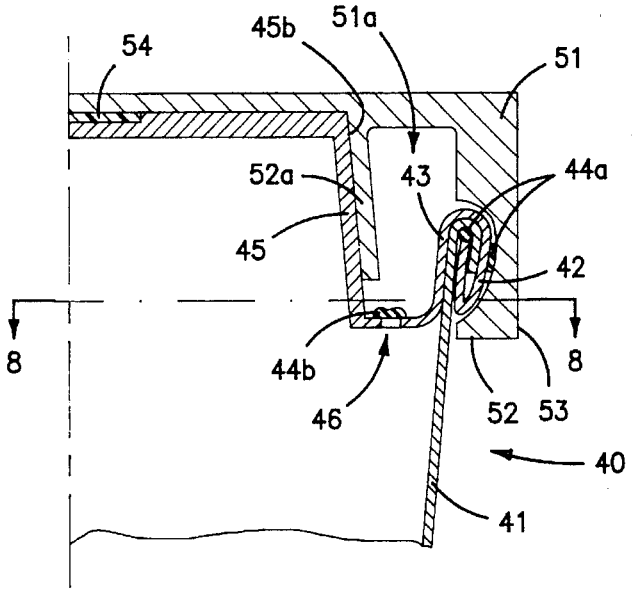
FIGS. 7 and 8 are views similar to FIGS. 1 and 2 showing an embodiment of the present invention.
Figure 8:
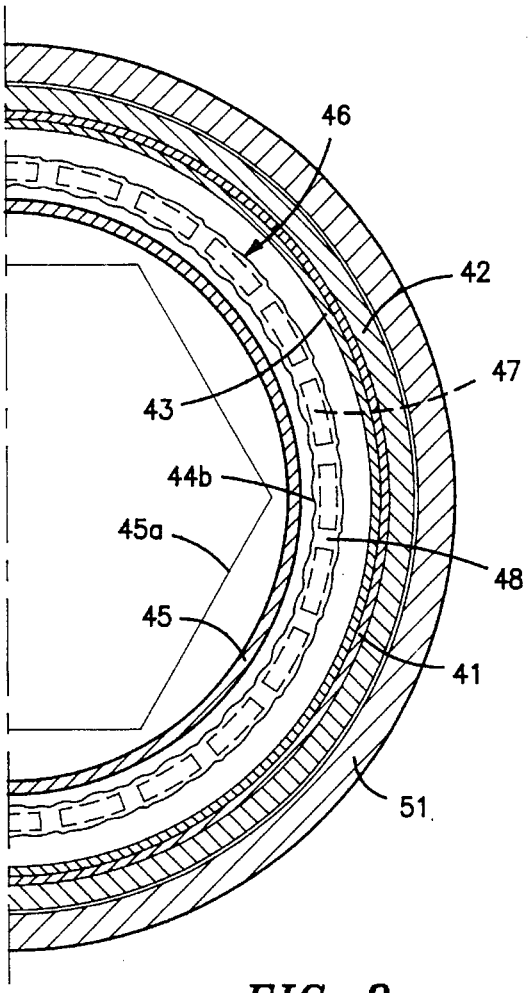

Referring to FIGS. 7 and 8, the container 40 of this embodiment is a metal can. Container 40 has a side wall 41 extending upwardly from a container bottom (not shown), with the container terminating in a conventional can double seam 42 formed conjointly with a lid, representing barrier layer 43. Both container and lid are made of metal, e.g., aluminum, according to this embodiment, but are not limited thereto, a plastic container and/or lid being usable as well. The double seam 42 forms a layered overlapping, curved structure in the conventional manner which contains a sealing compound 44*a*, as is well known. The barrier layer 43 exhibits a raised portion 45 containing for example a hexagonal section 45*a* and a stepped portion 45*b*, as also shown in the previous embodiments, and a weakened region 46. The weakening 46 consists of slots 47 alternating with tabs 48 dimensioned to be capable of being broken when sheared with the force a normal person is capable of exerting. Since slots 47 are a possible pathway for the escape of fluids from the container, it is desirable to seal them. This is readily accomplished by applying a sealant over slots 47 to block the slots, for example, sealing compound 44*b*, which may have the same composition as sealing compound 44*a*.

This is shown in FIG. 8. Naturally, it may not be necessary to seal the slots if the perforations do not go all the way through the barrier layer.

A removable closure 51 is provided over the container and barrier layer incorporating a recess 51*a* with a descending leg 52*a* with an inner contour corresponding to the outer shape of raised portion 45 of barrier layer 43, and an outer skirt 53 overlapping double seam 42 and extending around and below the seam, thereby forming a snap-on lid. Closure 51 may be injection molded plastic, or a metal stamping, and if the latter it may be in simpler form than shown herein. The outer surface of skirt 53 may be serrated, to promote an improved finger grip for turning the closure. Closure 51 may be joined to raised portion 45 as shown, as by adhesive 54.

In use, barrier layer 43 is double-seamed to side wall 41 as any other lid, thereby closing the container. Closure 51 is next pushed over the closed container, its recess 51*a* having been aligned with raised portion 45 of the barrier layer 43, until skirt 53 snaps in place. To open the container, closure 51 is turned, transmitting the turning torque onto the barrier layer 43 due to entrapment of raised portion 45 in recess 51*a*. The torque causes tabs 48 to shear and since sealing compound 44*b* offers no significant resistance, the assembly of barrier layer and closure may be removed together, thereby opening the container. If it is desired to reclose the container, the assembly may be snapped in place over double seam 42, as before, it being noted that to do so will only close the container, but will not resist internal pressure.

Removable closure 51 is provided over container 40 covering the double seam, reaching below it to contact the base of the double seam and at least a portion of the container side wall 41. The closure assembly has a retaining lip 52 engaging the end of the double seam 42 as shown so that the closure member may be engaged with the container for easy removal and re-closing, representing a snap closure. Naturally also a screw-closure may be used as with other embodiments.

As shown in FIG. 7, barrier layer central portion 45 has a stepped portion 45*b* extending outwardly, away from container body 41. Similarly, closure 51 includes a corresponding stepped portion or descending leg 52*a* also extending outwardly away from container side wall 41, all in a manner similar to FIG. 1. If desired, the closure member may be adhesively secured to the barrier layer.

The tabs 48 should be small, on the order of from 0.001 to 0.01 inch, and preferably about 0.010 inch.

Thus, in the embodiment of FIGS. 7 and 8, removal of the closure member by twisting transmits a torque to the corresponding stepped portion of the barrier layer and breaks the seal at the tabs 48, opening the container in a manner after the other embodiments.

The closure system in FIGS. 7 and 8 is also tamper proof as in the other embodiments since a positive tearing of the barrier is required for initial opening, which can be readily sensed. Removal of the snap-on closure without having to twist forcefully would show that the barrier had been tampered with.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container closure assembly which comprises: a container having an access opening for the container; a barrier layer having a rim and a central portion completely covering the access opening and with the barrier layer rim portion attached to said container, said barrier layer including a weakened portion in the central portion of the barrier layer, said weakened portion comprising at least one discontinuity in the barrier layer central portion; a removable closure member including means to cover said container access opening and barrier layer and engaging said barrier layer, said closure member intimately contacting said barrier layer when said closure member is removed by twisting; whereby removal of the closure member by twisting only breaks the barrier layer at the weakened portion by putting pressure on the weakened portion and opens the container.

2. An assembly according to claim 1 wherein said weakened portion is adjacent said barrier layer rim portion.

3. An assembly according to claim 1 wherein said barrier layer and closure member are metal.

4. An assembly according to claim 1 wherein said barrier layer and closure member are plastic.

5. An assembly according to claim 1 wherein the container is metal, barrier is plastic and closure is plastic.

6. A container according to claim 1 wherein said container is plastic, barrier is metal and closure is plastic.

7. An assembly according to claim 1 wherein the closure member and barrier layer include stepped portions adjacent one another over the access opening.

8. An assembly according to claim 7 wherein the stepped portions extend outwardly, away from the access opening.

9. An assembly according to claim 7 wherein the barrier layer stepped portions include corner portions thereof.

10. An assembly according to claim 1 wherein the discontinuity comprises a plurality of alternating slots and tabs circumscribing the barrier layer central portion.

11. An assembly according to claim 10 wherein said slots go completely through the barrier layer and are from 0.01–0.001 inch.

12. An assembly according to claim 11 wherein said slots are sealed by another material.

13. An assembly according to claim 12 wherein said another material has less shear strength than said tabs.

14. An assembly according to claim 1 wherein the closure member and barrier layer include stepped portions adjacent one another over the access opening, said barrier layer stepped portion including corner portions thereof, whereby twisting the closure member places the barrier layer stepped portion under torsion breaking the barrier layer at the weakened portion and opens the container.

* * * * *